United States Patent [19]

Gargione

[11] 4,395,043

[45] Jul. 26, 1983

[54] GAME CHIP

[75] Inventor: Frank Gargione, Absecon Highlands, N.J.

[73] Assignee: Keystone Bingo Products, Inc., Levittown, Pa.

[21] Appl. No.: 236,419

[22] Filed: Feb. 20, 1981

[51] Int. Cl.[3] ..... G09F 3/18; A63F 3/08

[52] U.S. Cl. ..... 273/239; 40/27.5; 40/10 D; 273/288

[58] Field of Search ..... 273/239, 128 R, 424, 273/269, 288, 293, 353, 128 R; 40/113, 115, 27.5, 10 D; 63/26

[56] References Cited

U.S. PATENT DOCUMENTS

| | | | |
|---|---|---|---|
| 411,392 | 9/1889 | Parker | 40/27.5 |
| 715,795 | 12/1902 | Haskell | 273/128 R |
| 1,475,652 | 11/1923 | Polizzi | 40/27.5 |
| 1,589,423 | 6/1926 | Payton | 63/26 X |
| 1,621,185 | 3/1927 | Bain | 273/284 |
| 1,934,653 | 11/1933 | Arthur | 63/26 |
| 1,962,927 | 6/1934 | Bats | 273/424 X |
| 2,410,845 | 11/1946 | Snell et al. | 40/27.5 X |
| 2,873,976 | 2/1959 | Alatorre | 273/293 |
| 3,964,187 | 6/1976 | Stumpf | 40/27.5 |
| 4,019,747 | 4/1977 | Chuilli | 273/239 |

FOREIGN PATENT DOCUMENTS

| | | | |
|---|---|---|---|
| 350528 | 6/1931 | United Kingdom | 273/288 |

*Primary Examiner*—Richard C. Pinkham
*Assistant Examiner*—S. L. Brown
*Attorney, Agent, or Firm*—Seidel, Gonda, Goldhammer & Panitch

[57] ABSTRACT

A chip for a game such as bingo includes a transparent or translucent circular disk surrounded by a ring. The ring has discrete flanges overlying and contacting the outer periphery of the opposite side faces of the disk. The ring is made from a smooth magnetizable sheet material.

8 Claims, 5 Drawing Figures

FIG. 1
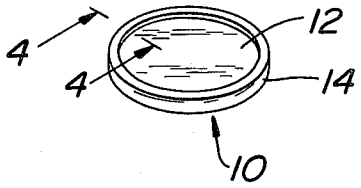
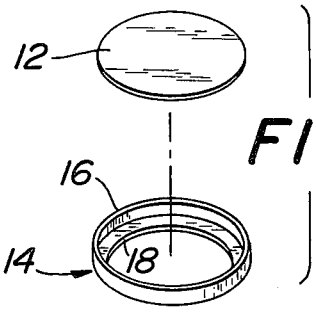
FIG. 2
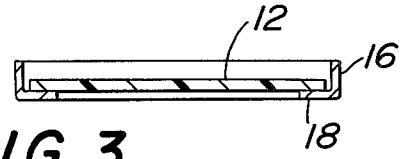
FIG. 3
FIG. 4
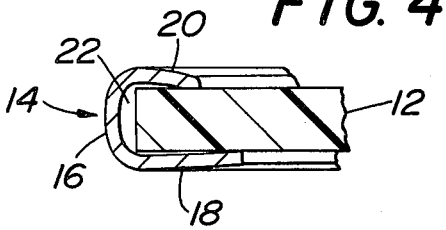
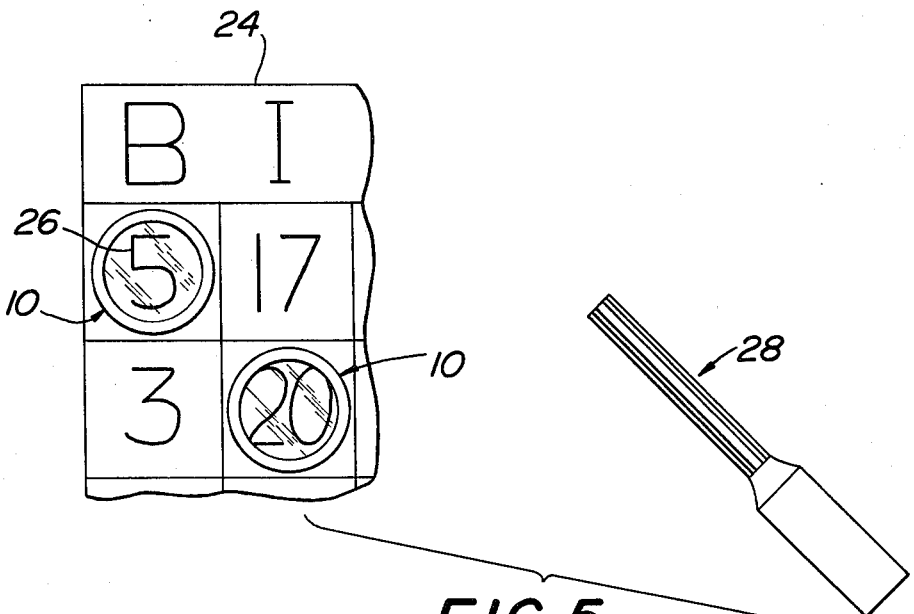
FIG. 5

GAME CHIP

BACKGROUND

Game chips for use in a game such as bingo are well known. The most relevant prior art game chips are those disclosed in U.S. Pat. Nos. 4,019,747 and 4,172,597.

In U.S. Pat. No. 4,019,747, there is illustrated a variety of constructions. The most relevant construction is shown in FIGS. 4, 4*a*. The chip disclosed in said patent is difficult and expensive to manufacture since the inner periphery of the ring must be knurled. Further, said patent specifically teaches that the ring must be thinner than the thickness of the disk whereby the major faces of the disk are free to contact the juxtaposed face of the bingo card. In accordance with the present invention, that feature is considered to be undesirable.

In U.S. Pat. No. 4,172,597, the transparent or translucent disk has a metal screen embedded therein. The metal screen partially obscures the numerals on the bingo card. Also, the wires utilized to form the screen have exposed ends at the outer periphery of the disk which may mark or scratch cards, other disks, a user's fingers, etc. and thereby are a safety hazard.

The game chip of the present invention solves the problems associated with the prior art described above and provides other advantages.

SUMMARY OF THE INVENTION

The present invention is directed to a game chip for use in a game such as bingo. The chip includes a circular disk of translucent or transparent material. A ring surrounds the disk with discrete flanges on the ring overlying and contacting the outer periphery of the opposite side faces of the disk. The ring is a smooth magnetizable sheet material free from burrs and wrinkles.

At least one of the flanges on the rings is inclined inwardly whereby the thickest portion of the chip is across the ring at the outer peripheral surface of the disk. A gap is provided between the outer periphery of the disk and the inner periphery of the ring.

It is an object of the present invention to provide a game chip which is inexpensive, safe to use, and easy to use.

It is another object of the present invention to provide a game chip which has smooth clean edges defined by a ring which is not removable and wherein the chip is easy to shift on the card while providing for greater visiblity.

Other objects and advantages will appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of a chip in accordance with the present invention.

FIG. 2 is an exploded view of a chip with the ring in an intermediate stage of production.

FIG. 3 is a sectional view of the components shown in FIG. 2.

FIG. 4 is a sectional view taken along the line 4—4 in FIG. 1 but on an enlarged scale.

FIG. 5 is a partial plan view of a playing card on which two chips are superimposed and a plan view of a pick-up device.

DETAILED DESCRIPTION

Referring to the drawings in detail, wherein like numerals indicate like elements, there is shown in FIG. 1 a perspective view of a game chip in accordance with the present invention designated generally as 10. The chip 10 includes a disk 12 surrounded by and supported by a ring 14. The flat disk 12 is preferably a transparent or translucent material such as polypropylene plastic. The preferred dimensions for disk 12 are a thickness of 0.020 inch and a diameter of 0.78 inch.

To facilitate ease of production on a mass production basis with minimum cost, the ring 14 is preferably preformed as shown in FIG. 2 so as to have an upstanding cylindrical wall 16 with an inwardly extending flange 18.

Preformed disks 12 are fed by machine so as to insert a disk 12 into each of the preformed rings 14 while the latter is in the shape shown in FIGS. 2 and 3. Thereafter, the wall 16 is rolled over the periphery of the disk so as to define flange 20. At least one and preferably each of the flanges 18 and 20 is inclined with respect to the major faces of the disk 12 so as to space the major faces of disk 12 from a juxtaposed surface. Such incline also minimizes exposed edges which can scratch other chips and things. The radial extent of flange 20 is less than that of flange 18 as shown more clearly in FIG. 4. The thickest portion of the chip 10 is across the ring 14 at the outer peripheral surface of the disk 12. The outer peripheral surface of the disk 12 is spaced from the wall 16 by a gap 22.

The ring 14 is made from a smooth magnetizable sheet material free from burrs and wrinkles. The preferred material for ring 14 is medium carbon steel. The preferred dimensions for ring 14 are an outer diameter of 0.840 inch with a tolerance of 0.005 inch using metal having a thickness of 0.005 inch, with flange 18 extending for a dimension of 0.075 inch and flange 20 extending for a dimension of about 0.06 inch, and wall 16 being about 0.09 inch high. A chip constructed in this manner will have a maximum thickness across the gap 22 of about 0.065 inch and wherein the major faces of the disk 12 will be spaced from any playing surface by a dimension slightly greater than the thickness of the material from which ring 14 is made.

The chip 10 will slide very easily over the surface of a playing card 24 since there will be essentially line contact between ring 14 and the surface of card 24. As shown in FIG. 5, the indicia 26 is readily and completely visible through the disk 12. There are no burrs or wire ends which can scratch. Since the major faces of the disk 12 do not contact the surface of card 24, there will be minimal abrasion to such surfaces which would ultimately effect the transparency of the disk 12. In addition to an attractive appearance, the disk 10 is easy to shift on the card. The disk 12 is not removable from the ring 14. The free ends of flanges 18 and 20 contact the faces of disk 12 and prevent the disk 12 from rotating relative to the ring 14.

The ring 14 when made from a magnetizable material such as medium carbon steel facilitates use of the disks in a well known manner whereby all of the disks at the end of a game may be removed from the card by use of a pick-up device 28 containing a magnet. As the device 28 is waved over the chips 10 while they overlie a face of the card 24, all of the chips will be attracted to the device 28 and removed from the card. This arrangement further minimizes any abrasion between the disk 10 and the surface of the card 24 whereby the cards will be usable for a longer period of time.

Thus, it will be seen that the chip of the present invention is easier to use, is cheaper to manufacture, while being safer than some prior art chips, while having greater visibility and less likelihood of scuffing either the chips or the playing cards.

The present invention may be embodied in other specific forms without departing from the spirit or essential attributes thereof and, accordingly, reference should be made to the appended claims, rather than to the foregoing specification, as indicating the scope of the invention.

I claim:

1. A game chip comprising a circular disk of translucent or transparent material, a ring surrounding said disk with discrete flanges on the ring overlying and contacting the outer periphery of the opposite side faces of said disk, said ring being a smooth magnetizable sheet material free from burrs and wrinkles, said sheet material being substantially thinner than the thickness of said disk, at least one of said flanges being inclined inwardly whereby the thickest portion of the chip is across the ring at the outer peripheral surface of the disk, the inner periphery of said ring being concave, and a gap between the outer periphery of said disk and the inner periphery of said ring.

2. A chip in accordance with claim 1 wherein the radial length of said flanges are different.

3. A chip in accordance with claim 2 wherein each of said flanges is inclined with respect to a juxtaposed side face of said disk.

4. A chip in accordance with claim 3 wherein said disk is made from a plastic material and said ring is made from steel having a thickness of about 0.005 inch.

5. A chip in accordance with claim 1 including a pick-up device having a magnet for attracting said ring to the device whereby a plurality of chips may be removed from a playing card simultaneously by said pick-up device.

6. A Bingo game chip adapted for use with a pick-up device having a magnet whereby a plurality of chips may be simultaneously removed from a playing card comprising a circular solid disk of translucent or transparent plastic material, a ring surrounding said disk with discrete flanges on the ring overlying and contacting an outer peripheral portion of the opposite side faces of the disk, the radial length of said flanges being different, said ring being a smooth magnetizable sheet material free from burs and wrinkles, said sheet material being substantially thinner than the thickness of said disk, at least one of said flanges being inclined inwardly whereby the thickest portion of the chip is across the ring at the outer periphery of the ring, the inner periphery of said ring being concave and spaced from the outer periphery of the disk.

7. A Bingo game chip in accordance with claim 6 wherein said sheet material is steel having a thickness of about 0.005 inches, said disk having a diameter of about 0.78 inches and a thickness of about 0.020 inches.

8. A Bingo game chip in accordance with claim 7 wherein said flanges have a length in a radial direction which is in the range of 0.06 to 0.075 inches.

* * * * *